US007726292B1

(12) United States Patent
Coleman

(10) Patent No.: US 7,726,292 B1
(45) Date of Patent: Jun. 1, 2010

(54) HANDHELD BALLOON LAUNCHING APPARATUS

(76) Inventor: Sean Coleman, 547 Lexington Ave., Brooklyn, NY (US) 11221

( * ) Notice: Subject to any disclaimer, the term of this patent is extended or adjusted under 35 U.S.C. 154(b) by 209 days.

(21) Appl. No.: 11/595,442

(22) Filed: Nov. 9, 2006

Related U.S. Application Data

(60) Provisional application No. 60/734,533, filed on Nov. 9, 2005.

(51) Int. Cl.
*F41B 7/08* (2006.01)
*F41B 7/00* (2006.01)

(52) U.S. Cl. ..... 124/27

(58) Field of Classification Search ..... 124/27, 124/16, 26, 31, 37
See application file for complete search history.

(56) References Cited

U.S. PATENT DOCUMENTS 183,124 A * 10/1876 Butterweck ..... 124/27
270,738 A * 1/1883 Butterweck ..... 124/2
1,240,987 A * 9/1917 Lefever ..... 124/27
2,825,324 A * 3/1958 Haas ..... 124/27
3,850,157 A * 11/1974 Prokupek ..... 124/27

* cited by examiner

*Primary Examiner*—John Ricci

(57) ABSTRACT

A handheld balloon launcher includes a housing with an axially offset chamber formed therein. A vertically registered intake port defines a linear passageway in which filled water balloons are stacked. A launching plate is selectively adaptable along a longitudinal length of the chamber. A trigger mechanism activates the launching plate between a compressed and an extended position. A mechanism returns the launching plate to the compressed position while simultaneously depositing one of the water balloons in front of the launching plate. The returning mechanism includes a spring member with a diameter equal to a diameter of the chamber and anchored to a proximal end thereof, and extendable along the longitudinal length of the chamber. The launching plate maintains a static relationship with the returning mechanism, and the returning mechanism is independently operable from the triggering mechanism.

15 Claims, 5 Drawing Sheets

HANDHELD BALLOON LAUNCHING APPARATUS

CROSS REFERENCE TO RELATED APPLICATIONS

This application claims the benefit of U.S. Provisional Application No. 60/734,533, filed Nov. 9, 2005.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to launching apparatuses and, more particularly, to a handheld balloon launching apparatus for assisting a user to propel a plurality of filled water balloons along a predetermined trajectory.

2. Prior Art

Toy balloons are typically made from latex rubber or similar expandable material, and are usually filled with air or other gas for use as a toy or decoration. Alternatively, many users desire to fill their balloons with water or other liquid so they may use them as "water balloons", which can then be thrown to intentionally break or "explode" upon impact with a target as such as the ground, or an unfortunate playmate. Most users fill a water balloon by expanding the balloon opening (neck) over a sink faucet, hose bib, drinking fountain, or other pressurized water supply fitting. The user then opens the water supply valve so that the pressurized water fills the balloon with water to the desired volume, whereupon the user closes the water supply valve, removes the filled balloon from the fitting, and ties off and seals the neck of the water balloon for play.

One prior art example shows game participant enclosure for a water balloon game that includes a plurality of side walls and an overhead protector and water balloon engager supported by the side walls. The protector and engager includes a water balloon opening sufficiently large for a water balloon to pass therethrough from the interior of the enclosure and a plurality of water openings sufficiently small to prevent water balloons from entering the enclosure. A water balloon launcher is disposed within the enclosure such that water balloons are launchable through the water balloon opening. In one aspect of the invention, two such enclosures are positioned a selected distance from each other and water balloons are launched from one enclosure to the other to splash the participants in the opposing enclosure. Unfortunately, such an apparatus is complicated and time consuming to set up, and also requires a large amount of free space in which to set up the apparatus.

Another prior art example shows a tossing game apparatus and method utilizing a compactable shield launching device, including a base, a shield support pivotally mounted to the base, with a shield positioned on the shield support. A launching device may be supported independently or off of the shield support to create a solid or compactable launching device which is selectively positionable in both an extended position and a flat compacted travel position. A filling station is also described which is either solid or movable between an extended filling position and a reduced volume travel position. Unfortunately, such an apparatus is complicated to use and not easily transportable. Such an apparatus is difficult for youths and those with limited dexterity to easily use.

Accordingly, a need remains for a handheld balloon launching apparatus in order to overcome the above-noted shortcomings. The present invention satisfies such a need by providing an apparatus that is simple and easy to use, is lightweight yet durable in design, and assists a user to propel a plurality of filled water balloons along a predetermined trajectory. Such an apparatus provides a new and exciting way to enjoy the classic game of water balloon toss. The apparatus conveniently provides a user with a fun and thrilling alternative to throwing water balloons by hand. The apparatus allows a user to effectively deliver a multitude of filled water balloons to a target without having to stop and refill more water balloons. The present invention is inexpensive, simple to operate, and designed for many years of repeated use.

BRIEF SUMMARY OF THE INVENTION

In view of the foregoing background, it is therefore an object of the present invention to provide an apparatus for a handheld water balloon launching apparatus. These and other objects, features, and advantages of the invention are provided by a handheld balloon launching apparatus for assisting a user to propel a plurality of filled water balloons along a predetermined trajectory The apparatus includes a tubular housing that has an axially offset chamber formed therein. Such a housing further has a vertically registered intake port effectively defining a linear passageway in which the filled water balloons are vertically stacked. A launching plate has a curvilinear shape conforming to an outer contour of a water balloon, and is selectively adaptable along a longitudinal length of the chamber. A trigger mechanism conveniently activates the launching plate between a compressed position and a fully extended position.

The triggering mechanism includes a primary trigger pivotally connected to the housing and partially exposed exterior thereof. A rectilinear rod has a distal end directly anchored to the primary trigger and has a proximal end horizontally offset and sloped downwardly towards a proximal end of the housing. An auxiliary trigger is pivotally connected to the housing and directly mated with the proximal end of the rod. Such an auxiliary trigger is directly and releasably engaged with a bottom portion of the launching plate while the launching mechanism (herein described below) is advantageously maintained at the compressed position. The primary trigger rotates along a first arcuate path when depressed by a user to thereby effectively cause the rod to linearly displace distally and thereby rotate the auxiliary trigger along a second arcuate path effectively defined opposite to the first arcuate path.

The triggering mechanism further includes an anchoring bracket directly connected to an outer surface of the chamber and a deformably resilient spring member that has axially opposed ends directly connected to the bracket and the auxiliary trigger respectively. Such a spring member is conveniently expandable along a rectilinear path effectively defined parallel to the chamber and therefore automatically causes the bracket to return along an arcuate path defined opposite to the second arcuate path until the spring member advantageously returns to an equilibrium position.

The apparatus further includes a mechanism for returning the launching plate to the compressed position while simultaneously depositing a lowest one of the water balloons directly in front of and abutted distally to the launching plate such that an adjacent one of the water balloons seated on top of the lowest water balloon is advantageously prohibited from entering the chamber. Such a returning mechanism includes a deformably resilient spring member that has a diameter substantially equal to a diameter of the chamber and is advantageously anchored to a proximal end of the chamber. Such a spring member is conveniently extendable along the longitudinal length of the chamber. The launching plate effectively maintains a static relationship with the returning mechanism during launching operations, and the returning mechanism is independently operable from the triggering mechanism.

The launching plate return mechanism further includes a segmented linear return plate that has an opening formed therein that effectively defines the plate into proximal and distal segments. Such a distal segment has a lever monolithically formed therewith that terminates exterior of the housing. The housing includes a linear slot formed adjacent to a top edge thereof. The return plate is directly and monolithically coupled to the launching plate such that the user can manually position the return plate proximally along the chamber and thereby advantageously return the launching plate to the compressed position. The opening of the return plate becomes vertically aligned with the passageway for effectively allowing the lowest one of the water balloons to advantageously fall through the opening and conveniently rest against the launching plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither-intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
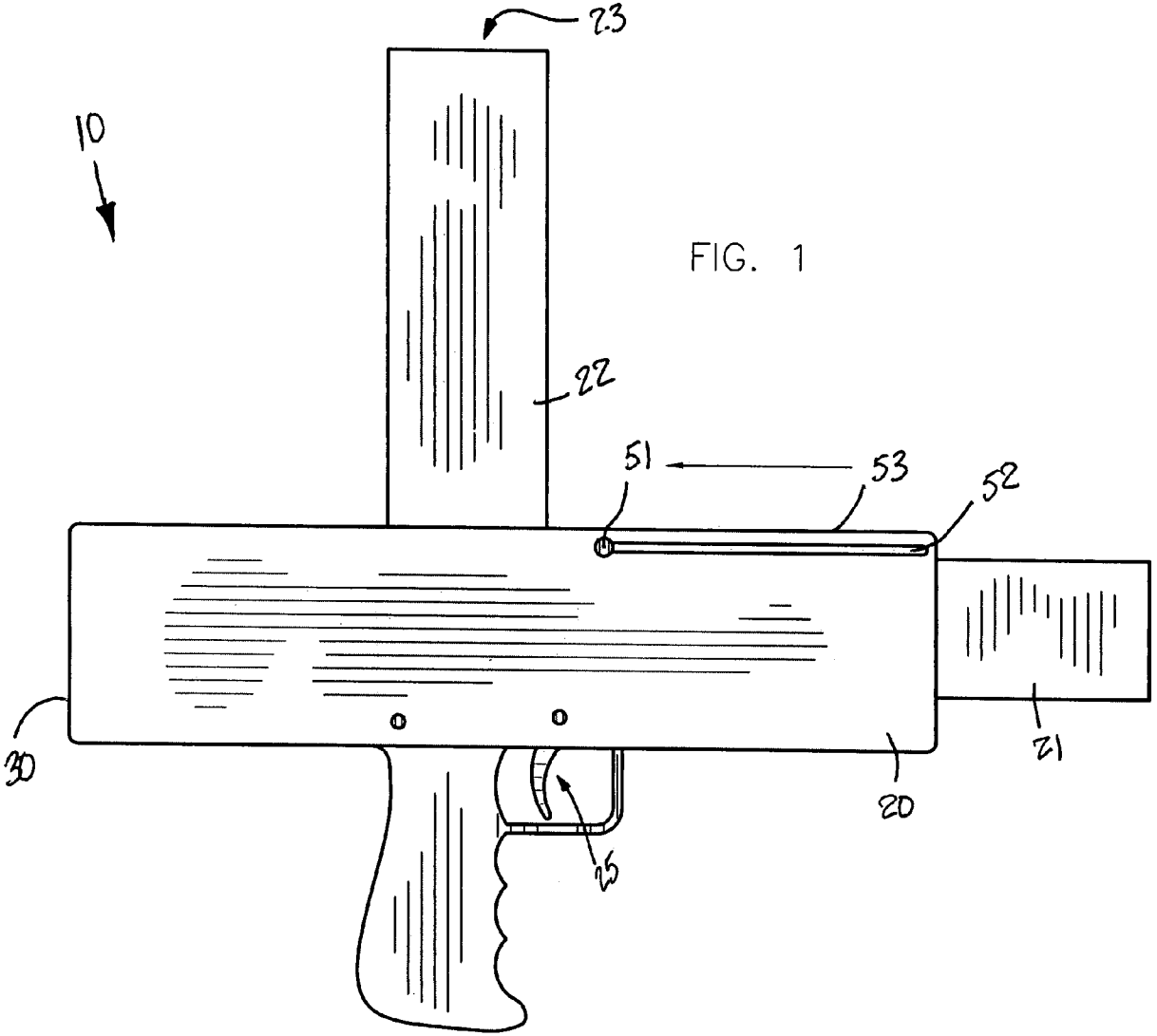
FIG. 1 is a side elevational view of a handheld balloon launching apparatus showing the apparatus in a pre-launching state, in accordance with the present invention.
Figure 2:
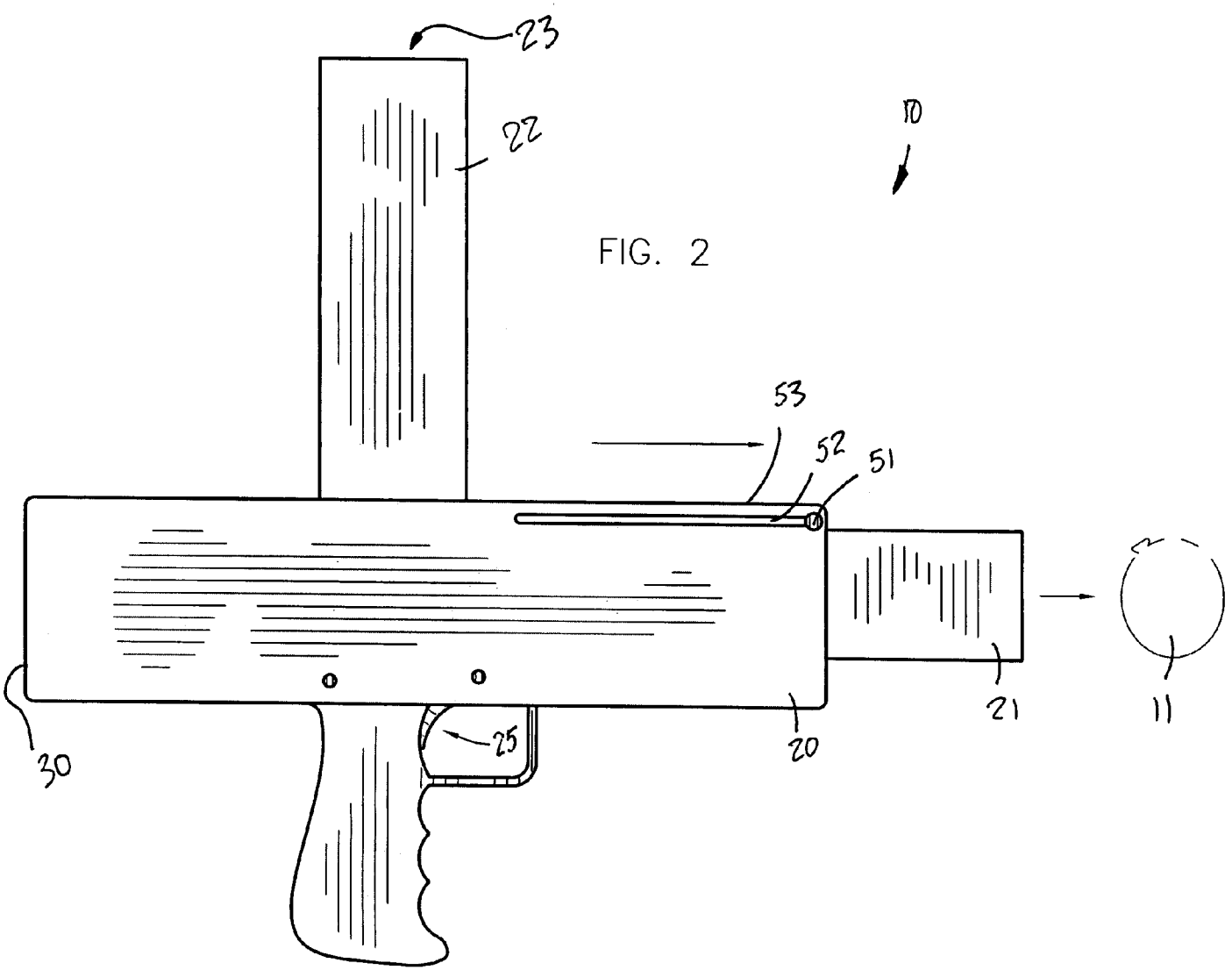
FIG. 2 is a side elevational view of the apparatus shown in FIG. 1 showing the apparatus in a post-launching state.
Figure 3:
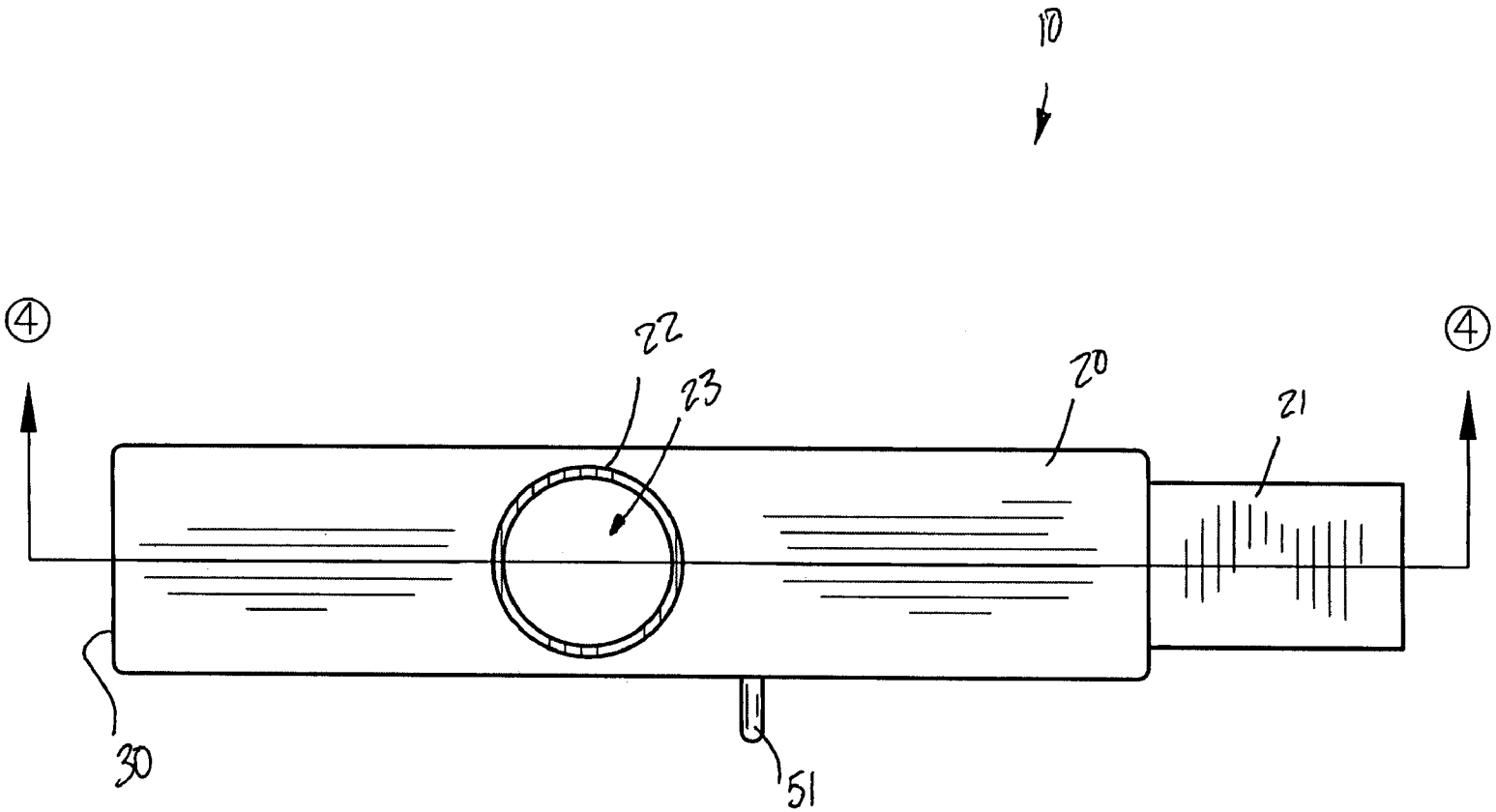
FIG. 3 is a top plan view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a handheld balloon launching apparatus. It should be understood that the apparatus 10 may be used to launch many different types of objects and should not be limited in use to launching only those types of objects described herein.

Referring initially to FIGS. 1, 2, 3, 4 and 5, the apparatus 10 includes a tubular housing 20 that has an axially offset chamber 21 formed therein. Such a housing 20 further has a vertically registered intake port 22 defining a linear passageway 23 in which the filled water balloons 11 are vertically stacked. A launching plate 24 has a curvilinear shape conforming to an outer contour of a water balloon 11, and is selectively adaptable along a longitudinal length of the chamber 21. A trigger mechanism 25 activates the launching plate 24 between a compressed position and a fully extended position.

Figure 4:
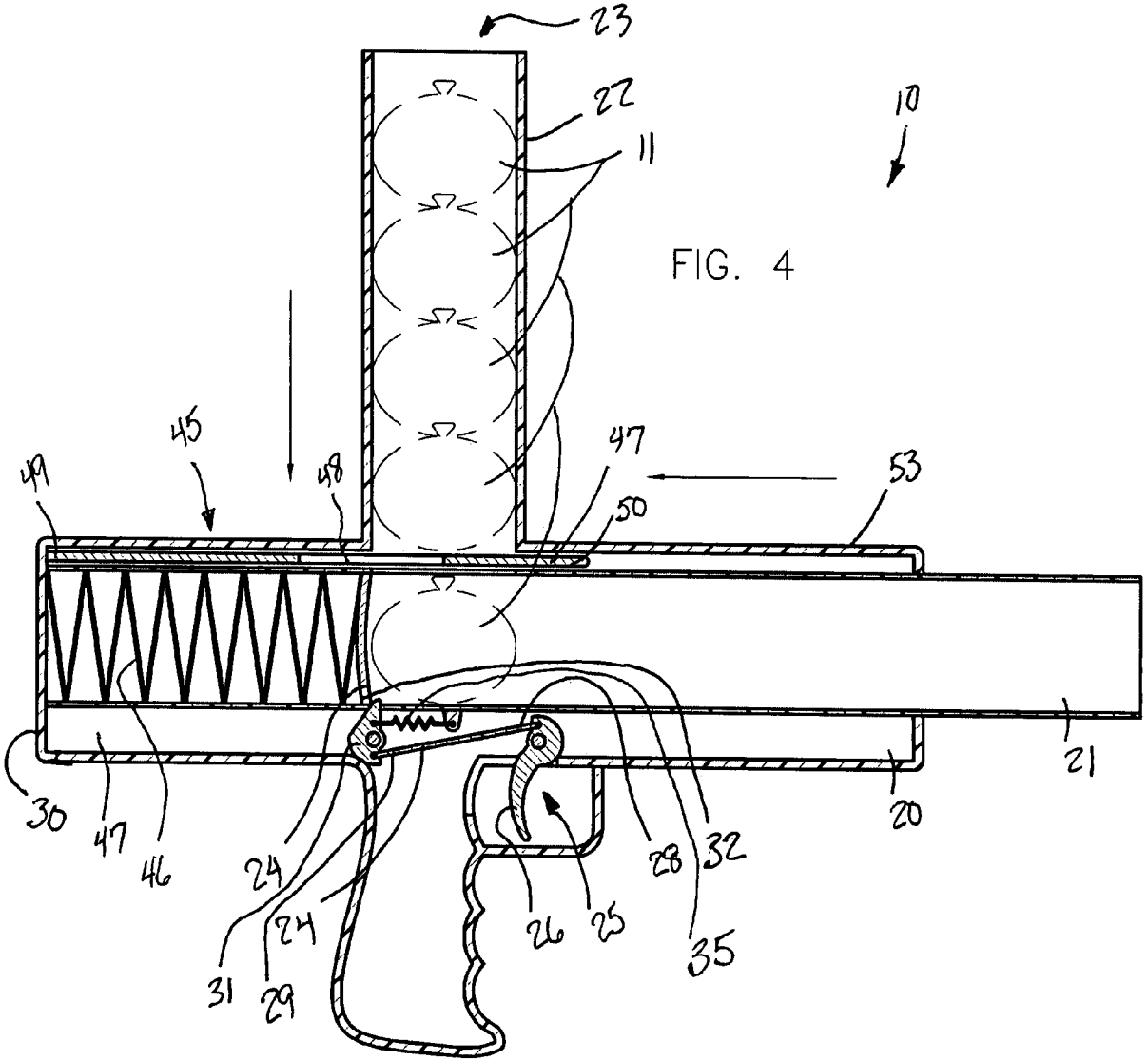
FIG. 4 is a cross sectional view of the apparatus shown in FIG. 3, taken along line 4-4.
Figure 5:
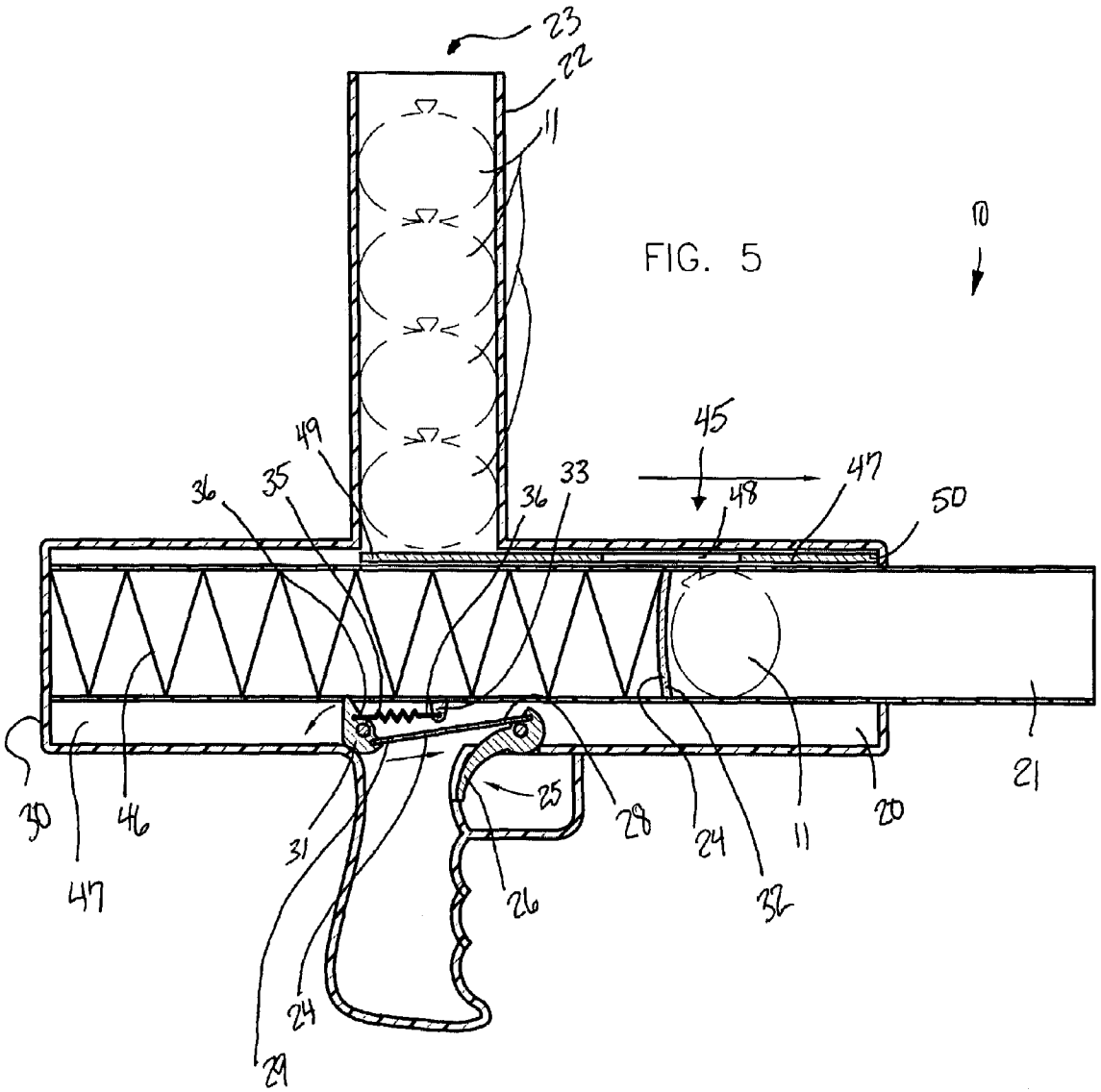
FIG. 5 is a cross sectional view of the apparatus shown in FIG. 4 showing the spring member in a fully extended position.

Referring to FIGS. 4 and 5, the triggering mechanism 25 includes a primary trigger 26 pivotally connected to the housing 20 and partially exposed exterior thereof. A rectilinear rod 27 has a distal end 28 directly anchored to the primary trigger 26 and has a proximal end 29 horizontally offset and sloped downwardly towards a proximal end 30 of the housing 20.

An auxiliary trigger 31 is pivotally connected to the housing 20 and directly mated with the proximal end 29 of the rod 27, without the use of intervening elements. Such an auxiliary trigger 31 is directly and releasably engaged, without the use of intervening elements, with a bottom portion 32 of the launching plate 24 while the returning mechanism 45 (herein described below) is advantageously maintained at the compressed position. The primary trigger 26 rotates along a first arcuate path when depressed by a user, which is essential to thereby cause the rod 27 to linearly displace distally and thereby rotate the auxiliary trigger 31 along a second arcuate path defined opposite to the first arcuate path.

Again referring to FIGS. 4 and 5, the triggering mechanism 25 further includes an anchoring bracket 33 directly connected to an outer surface of the chamber 21, without the use of intervening elements, and a deformably resilient spring member 35 that has axially opposed ends 36 directly connected, without the use of intervening elements, to the bracket 33 and the auxiliary trigger 31 respectively. Such a spring member 35 is expandable along a rectilinear path defined parallel to the chamber 21 and therefore automatically causes the bracket 33 to return along an arcuate path defined opposite to the second arcuate path until the spring member 35 advantageously returns to an equilibrium position. Of course, such a spring member 35 can be produced in a variety of shapes and sizes, as is obvious to a person of ordinary skill in the art.

Yet again referring to FIGS. 4 and 5, the apparatus 10 further includes a mechanism 45 for returning the launching plate 24 to the compressed position while simultaneously depositing a lowest one of the water balloons 11 directly in front of and abutted distally to the launching plate 24, without the use of intervening elements, which is critical such that an adjacent one of the water balloons 11 seated on top of the lowest water balloon 11 is advantageously prohibited from entering the chamber 21. Such a returning mechanism 45 includes a deformably resilient spring member 46 that has a diameter substantially equal to a diameter of the chamber 21 and is advantageously anchored to a proximal end 47 of the chamber 21. Such a spring member 46 is extendable along the longitudinal length of the chamber 21, and of course, such a spring member 46 can be produced in a variety of shapes and sizes, as is obvious to a person of ordinary skill in the art. The launching plate 24 maintains a static relationship with the returning mechanism 45 during launching operations, and the returning mechanism 45 is independently operable from the triggering mechanism 25.

Again referring to FIGS. 1 through 5, the launching plate return mechanism 45 further includes a segmented linear return plate 47 that has an opening 48 formed therein that defines the plate 47 into proximal 49 and distal 50 segments. Such a distal segment 50 has a lever 51 monolithically formed therewith that terminates exterior of the housing 20. The housing 20 includes a linear slot 52 formed adjacent to a top edge 53 thereof. The return plate 47 is directly and monolithically coupled to the launching plate 24, without the use of intervening elements, which is crucial such that the user can manually position the return plate 47 proximally along the chamber 20 and thereby advantageously return the launching plate 24 to the compressed position.

The opening 48 of the return plate 47 becomes vertically aligned with the passageway 23, which is vital for allowing the lowest one of the water balloons 11 to advantageously fall through the opening 48 and rest against the launching plate 24. Of course, such an opening 48 can be produced in a variety of shapes and sizes, as is obvious to a person of ordinary skill in the art so long as the opening restricts downwardly movement of the balloons when the launching plate 24 is cocked to a compressed position.

The ability to load and house a plurality of filled water balloons 11 into the intake port 22 provides the unexpected benefit of allowing a user to rapidly launch a multitude of water balloons 11 at a target without having to frequently refill and reload water balloons 11 into the apparatus 10, thereby overcoming prior art shortcomings.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A handheld balloon launching apparatus for assisting a user to propel a plurality of filled water balloons along a predetermined trajectory, said balloon launching apparatus comprising:

a tubular housing having an axially offset chamber formed therein, said housing further having a vertically registered intake port defining a linear passageway in which the filled water balloons are vertically stacked;

a launching plate selectively adaptable along a longitudinal length of said chamber;

trigger means for activating said launching plate between a compressed position and a fully extended position; and means for returning said launching plate to the compressed position while simultaneously depositing a lowest one of said water balloons directly in front of and abutted distally to said launching plate such that an adjacent one of the water balloons seated on top of said lowest water balloon is prohibited from entering said chamber, wherein said returning means includes a deformably resilient spring member having a diameter substantially equal to a diameter of said chamber and being anchored to a proximal end of said chamber, said spring member being extendable along the longitudinal length of said chamber;

wherein said triggering means comprises:

a primary trigger pivotally connected to said housing and partially exposed exterior thereof;

a rectilinear rod having a distal end directly anchored to said primary trigger and having a proximal end horizontally offset and sloped downwardly towards a proximal end of said housing; and an auxiliary trigger pivotally connected to said housing and directly mated with said proximal end of said rod, wherein said auxiliary trigger is directly and releasably engaged with a bottom portion of said launching plate while said returning means is maintained at the compressed position, wherein said pimary trigger rotates along a first arcuate path when depressed by a user to thereby cause said rod to linearly displace distally and thereby rotate said auxiliary trigger along a second arcuate path defined opposite to said first arcuate path.

2. The balloon launching apparatus of claim 1, wherein said triggering means further comprises:

an anchoring bracket directly connected to an outer surface of said chamber; and a deformably resilient spring member having axially opposed ends directly connected to said bracket and said auxiliary trigger respectively, said spring member being expandable along a rectilinear path defined parallel to said chamber and therefore automatically causing said bracket to return along an arcuate path defined opposite to said second arcuate path until said spring member returns to an equilibrium position.

3. The balloon launching apparatus of claim 1, wherein said launching plate return means comprises:

a segmented linear return plate having an opening formed therein and defining said plate into proximal and distal segments, said distal segment having a lever monolithically formed therewith and terminating exterior of said housing, said housing including a linear slot formed adjacent to a top edge thereof, said return plate being directly and monolithically coupled to said launching plate such that the user can manually position the return plate proximally along said chamber and thereby return said launching plate to the compressed position.

4. The balloon launching apparatus of claim 3, wherein said opening of said return plate becomes vertically aligned with the passageway for allowing the lowest one of the water balloons to fall through said opening and rest against said launching plate.

5. The balloon launching apparatus of claim 4, wherein said launching plate has a curvilinear shape conforming to an outer contour of the water balloon.

6. A handheld balloon launching apparatus for assisting a user to propel a plurality of filled water balloons along a predetermined trajectory, said balloon launching apparatus comprising:

a tubular housing having an axially offset chamber formed therein, said housing further having a vertically registered intake port defining a linear passageway in which the filled water balloons are vertically stacked;

a launching plate selectively adaptable along a longitudinal length of said chamber;

trigger means for activating said launching plate between a compressed position and a fully extended position; and means for returning said launching plate to the compressed position while simultaneously depositing a lowest one of said water balloons directly in front of and abutted distally to said launching plate such that an adjacent one of the water balloons seated on top of said lowest water balloon is prohibited from entering said chamber, wherein said returning means includes a deformably resilient spring member having a diameter substantially equal to a diameter of said chamber and being anchored to a proximal end of said chamber, said spring member being extendable along the longitudinal length of said chamber, wherein said returning means is independently operable from said triggering means;

wherein said triggering means comprises:

a primary trigger pivotally connected to said housing and partially exposed exterior thereof;

a rectilinear rod having a distal end directly anchored to said primary trigger and having a proximal end horizontally offset and sloped downwardly towards a proximal end of said housing; and an auxiliary trigger pivotally connected to said housing and directly mated with said proximal end of said rod, wherein said auxiliary trigger is directly and releasably engaged with a bottom portion of said launching plate while said returning means is maintained at the compressed position, wherein said primary trigger rotates along a first arcuate path when depressed by a user to thereby cause said rod to linearly displace distally and thereby rotate said auxiliary trigger along a second arcuate path defined opposite to said first arcuate path.

7. The balloon launching apparatus of claim 6, wherein said triggering means further comprises:

an anchoring bracket directly connected to an outer surface of said chamber; and a deformably resilient spring member having axially opposed ends directly connected to said bracket and said auxiliary trigger respectively, said spring member being expandable along a rectilinear path defined parallel to said chamber and therefore automatically causing said bracket to return along an arcuate path defined opposite to said second arcuate path until said spring member returns to an equilibrium position.

8. The balloon launching apparatus of claim 6, wherein said launching plate return means comprises:

a segmented linear return plate having an opening formed therein and defining said plate into proximal and distal segments, said distal segment having a lever monolithically formed therewith and terminating exterior of said housing, said housing including a linear slot formed adjacent to a top edge thereof, said return plate being directly and monolithically coupled to said launching plate such that the user can manually position the return plate proximally along said chamber and thereby return said launching plate to the compressed position.

9. The balloon launching apparatus of claim 8, wherein said opening of said return plate becomes vertically aligned with the passageway for allowing the lowest one of the water balloons to fall through said opening and rest against said launching plate.

10. The balloon launching apparatus of claim 9, wherein said launching plate has a curvilinear shape conforming to an outer contour of the water balloon.

11. A handheld balloon launching apparatus for assisting a user to propel a plurality of filled water balloons along a predetermined trajectory, said balloon launching apparatus comprising:

a tubular housing having an axially offset chamber formed therein, said housing further having a vertically registered intake port defining a linear passageway in which the filled water balloons are vertically stacked;

a launching plate selectively adaptable along a longitudinal length of said chamber;

trigger means for activating said launching plate between a compressed position and a fully extended position; and means for returning said launching plate to the compressed position while simultaneously depositing a lowest one of said water balloons directly in front of and abutted distally to said launching plate such that an adjacent one of the water balloons seated on top of said lowest water balloon is prohibited from entering said chamber, wherein said returning means includes a deformably resilient spring member having a diameter substantially equal to a diameter of said chamber and being anchored to a proximal end of said chamber, said spring member being extendable along the longitudinal length of said chamber, wherein said launching plate maintains a static relationship with said return means during launching operations, wherein said returning means is independently operable from said triggering means;

wherein said triggering means comprises:

a primary trigger Pivotally connected to said housing and partially exposed exterior thereof;

a rectilinear rod having a distal end directly anchored to said primary trigger and having a proximal end horizontally offset and sloped downwardly towards a proximal end of said housing; and an auxiliary trigger pivotally connected to said housing and directly mated with said proximal end of said rod, wherein said auxiliary trigger is directly and releasably engaged with a bottom portion of said launching plate while said returning means is maintained at the compressed position, wherein said primary trigger rotates along a first arcuate path when depressed by a user to thereby cause said rod to linearly displace distally and thereby rotate said auxiliary trigger along a second arcuate path defined opposite to said first arcuate path.

12. The balloon launching apparatus of claim 11, wherein said triggering means further comprises:

an anchoring bracket directly connected to an outer surface of said chamber; and a deformably resilient spring member having axially opposed ends directly connected to said bracket and said auxiliary trigger respectively, said spring member being expandable along a rectilinear path defined parallel to said chamber and therefore automatically causing said bracket to return along an arcuate path defined opposite to said second arcuate path until said spring member returns to an equilibrium position.

13. The balloon launching apparatus of claim 11, wherein said launching plate return means comprises:

a segmented linear return plate having an opening formed therein and defining said plate into proximal and distal segments, said distal segment having a lever monolithically formed therewith and terminating exterior of said housing, said housing including a linear slot formed adjacent to a top edge thereof, said return plate being directly and monolithically coupled to said launching plate such that the user can manually position the return plate proximally along said chamber and thereby return said launching plate to the compressed position.

14. The balloon launching apparatus of claim 13, wherein said opening of said return plate becomes vertically aligned with the passageway for allowing the lowest one of the water balloons to fall through said opening and rest against said launching plate.

15. The balloon launching apparatus of claim 14, wherein said launching plate has a curvilinear shape conforming to an outer contour of the water balloon.

* * * * *